US010944166B1

(12) United States Patent
Volakis et al.

(10) Patent No.: US 10,944,166 B1
(45) Date of Patent: Mar. 9, 2021

(54) BALUN FOR INCREASING ISOLATION IN SIMULTANEOUS TRANSMIT AND RECEIVE ANTENNAS

(71) Applicants: John L. Volakis, Miami, FL (US); Satheesh Bojja Venkatakrishnan, Miami, FL (US); Alexander Hovsepian, Miami, FL (US)

(72) Inventors: John L. Volakis, Miami, FL (US); Satheesh Bojja Venkatakrishnan, Miami, FL (US); Alexander Hovsepian, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 3 days.

(21) Appl. No.: 16/789,694

(22) Filed: Feb. 13, 2020

(51) Int. Cl.

| | |
|---|---|
| ***H01Q 1/38*** | (2006.01) |
| ***H01Q 1/52*** | (2006.01) |
| ***H01Q 1/48*** | (2006.01) |
| ***H01Q 9/16*** | (2006.01) |
| ***H01Q 7/00*** | (2006.01) |
| ***H01Q 9/30*** | (2006.01) |

(52) U.S. Cl.
CPC ..... *H01Q 1/52* (2013.01); *H01Q 1/48* (2013.01); *H01Q 7/00* (2013.01); *H01Q 9/16* (2013.01); *H01Q 9/30* (2013.01)

(58) Field of Classification Search
CPC .. H01Q 1/52; H01Q 9/30; H01Q 7/00; H01Q 9/16; H01Q 1/48
See application file for complete search history.

(56) References Cited

U.S. PATENT DOCUMENTS

| | | | | |
|---|---|---|---|---|
| 2008/0288024 | A1* | 11/2008 | Abrahamson | H01Q 1/22 607/60 |
| 2011/0074649 | A1* | 3/2011 | Isom | H01Q 13/085 343/859 |
| 2015/0077308 | A1* | 3/2015 | Jeon | H01Q 1/36 343/895 |
| 2015/0357720 | A1* | 12/2015 | Chen | H01Q 1/521 343/727 |
| 2020/0028268 | A1* | 1/2020 | Elmansouri | H01Q 21/205 |
| 2020/0076079 | A1* | 3/2020 | Shan | H01Q 19/108 |

FOREIGN PATENT DOCUMENTS

| | | | |
|---|---|---|---|
| GB | 2270594 | * | 3/1994 |

* cited by examiner

*Primary Examiner* — Dameon E Levi
*Assistant Examiner* — David E Lotter
(74) *Attorney, Agent, or Firm* — Saliwanchik, Lloyd & Eisenschenk

(57) ABSTRACT

Baluns and antenna devices that achieve improved antenna isolation for simultaneous transmit and receive (STAR) antennas are provided. A tunable balun can be used to compensate for amplitude imbalances in a multi-antenna radio, and/or an antenna agnostic feed network can be used to improve isolation in a single antenna radio. The balun can be integrated directly into the antenna. The balun can control the amplitude of each signal to ensure they are equal, resulting in greater transmitter interference cancellation.

13 Claims, 21 Drawing Sheets

BALUN FOR INCREASING ISOLATION IN SIMULTANEOUS TRANSMIT AND RECEIVE ANTENNAS

BACKGROUND

The radio frequency (RF) spectrum has limited availability of new slots and is costly. Increasing spectral efficiency is therefore desirable, particularly, in the 1-6 gigahertz (GHz) band. Simultaneous transmit and receive (STAR) enables radios to concurrently receive on bandwidth assigned for transmission, which is not possible with time/frequency division duplexing (TDD/FDD). Transmit/Receive (Tx/Rx) isolation is based on the inherent cancellation of the Tx interference coupled to the Rx feed. Consequently, a total isolation of 100-120 decibels (dB) is required to completely suppress the Tx interference below the receiver's noise floor. In multi-stage STAR systems, increasing antenna isolation reduces the level of cancellation required by analog and digital self-interference cancellation (SIC) filters. Additionally, the Tx interference power is reduced to a level that does not saturate receiver components such as low noise amplifier (LNA) and digitizers (e.g., analog-to-digital converters (ADCs)).

A class of high isolation, orthogonally polarized antennas has limited isolation due to manufacturing and balun feed asymmetry that may not be precisely predictable before manufacturing. The antenna isolation level is limited to about 30-40 dB across wide bandwidths. Alternatively, in single antenna radios, the isolation is limited to about 20 dB, depending on the circulator isolation.

BRIEF SUMMARY

Embodiments of the subject invention provide novel and advantageous baluns and antenna devices that achieve improved antenna isolation for simultaneous transmit and receive (STAR) antennas. An isolation of greater than 40 decibels (dB) (e.g., greater than 42 dB, such as in a range of 42-55 dB) can be achieved in single-antenna and multi-antenna radios. A tunable balun can be used to compensate for amplitude imbalances in a multi-antenna radio, and/or an antenna agnostic feed network can be used to improve isolation in a single antenna radio. The balun can be integrated directly into the antenna. A balun is a device used in balanced antennas (i.e., antennas that require feeding with two equal but opposite signals) to convert one signal into two equal but opposite copies of itself. In embodiments of the subject invention, the balun can control the amplitude of each signal (e.g., respective signals of two arms of a receive (Rx) antenna) to ensure they are equal, resulting in greater transmitter (Tx) interference cancellation. These amplitude imbalances can be introduced through manufacturing imperfections and assembly variations, adding asymmetry to the balun and/or antenna, thereby lowering the isolation. The amount of asymmetry may not be precisely predictable before manufacturing.

In an embodiment, an antenna device can comprise: a transmitter antenna portion (Tx); a receiver antenna portion (Rx); and a balun disposed on at least one of the Tx or the Rx, and the balun can have an attenuator chip thereon and can be a tunable balun. The balun can be disposed on (and integrated with) the Rx. The device can further comprise a ground plane disposed under the Rx and the Tx. The Tx can be a monopole antenna, and the Rx being a ring antenna, such as a horizontally polarized ring antenna comprising a first dipole and a second dipole wrapped in a ring shape. The balun can be an exponential tapered balun, such as an exponential tapered microstrip balun. The antenna device can be configured such that the attenuator chip is controlled by a direct current (DC) voltage, and the device can also be configured such an isolation between the Rx and Tx of greater than 42 dB is achieved. The balun can comprise a balun pin and a balun ground at a distal end thereof. The balun can be connected to the Rx at a proximal end thereof opposite from the distal end, and the attenuator chip can be disposed on the balun closer to the proximal end than it is to the distal end. The balun ground can be electrically connected to the first dipole of the Rx, and the balun pin can be electrically connected to the second dipole of the Rx. The attenuator chip can comprise an attenuator and a control circuit (electrically and/or directly) connected to the attenuator. The attenuator can comprise eight pins, which can include two radio frequency (RF) pins, two ground pins, and two voltage pins (see also, e.g., FIG. 22).

In another embodiment, a balun for use with a STAR antenna can comprise: a substrate; a balun pin; a balun ground; a first trace disposed on the substrate and (electrically and/or directly) connected to the balun pin; a second trace disposed on the substrate and (electrically and/or directly) connected to the balun ground; and an attenuator chip disposed on the substrate and electrically connected (could be directly connected) to the first trace and the second trace. The balun can be an exponential tapered balun, such as an exponential tapered microstrip balun. The balun can be configured such that the attenuator chip is controlled by a DC voltage. The attenuator chip can comprise an attenuator and a control circuit (electrically and/or directly) connected to the attenuator. The attenuator can comprise eight pins, which can include two RF pins, two ground pins, and two voltage pins.

BRIEF DESCRIPTION OF DRAWINGS

FIG. 26 shows results for the balun being tuned or untuned, with an increased isolation of about 11 dB when the balun is tuned.

DETAILED DESCRIPTION

Embodiments of the subject invention provide novel and advantageous baluns and antenna devices that achieve improved antenna isolation for simultaneous transmit and receive (STAR) antennas. An isolation of greater than 40 decibels (dB) (e.g., greater than 42 dB, such as in a range of 42-55 dB) can be achieved in single-antenna and multi-antenna radios. A tunable balun can be used to compensate for amplitude imbalances in a multi-antenna radio, and/or an antenna agnostic feed network can be used to improve isolation in a single antenna radio. The balun can be integrated directly into the antenna. A balun is a device used in balanced antennas (i.e., antennas that require feeding with two equal but opposite signals) to convert one signal into two equal but opposite copies of itself. In embodiments of the subject invention, the balun can control the amplitude of each signal (e.g., respective signals of two arms of a receive (Rx) antenna) to ensure they are equal, resulting in greater transmitter (Tx) interference cancellation.

Embodiments of the subject invention improve the antenna isolation (propagation domain) in single-antenna and multi-antenna radios. Achieving maximum cancellation in initial stages plays an important role in successful STAR realization. Embodiments provide several advantages, including: 1) devices can be inserted in existing radios, irrespective of antenna type; 2) suppression of all signal components from the transmit chain, including high power direct transmit signals, harmonics from power amplifiers, and noise coupling from the transmit chain, and 3) enablement of size, weight, power, and cost (SWaP-C) implementation due to the passive nature with little to no power consumption.

Many multi-antenna radios exploit balanced feeding to achieve improved antenna isolation. The cancellation is produced through the symmetric structure and balanced feeding of the antenna(s). However, the isolation level is limited by the signal amplitude imbalance of the balun at the antenna feed point. This varies based on manufacturing tolerances and is in general not predictable to the level desired for high isolation. Embodiments of the subject invention address this shortfall by employing tunable baluns.

Figure 1:
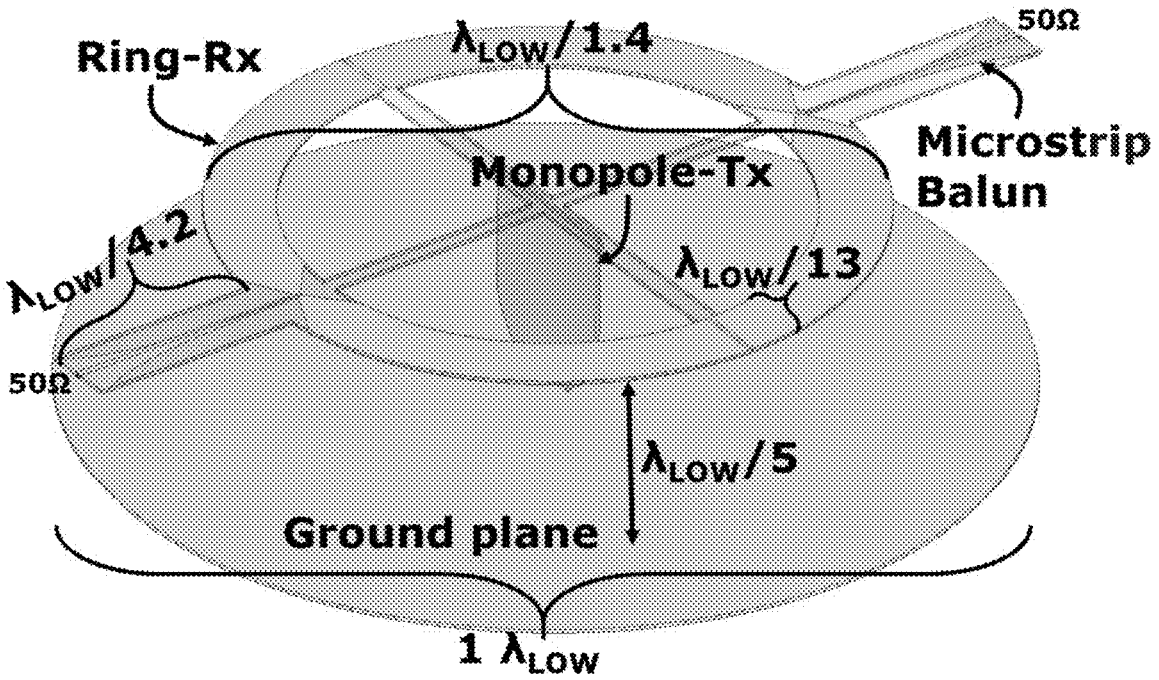
FIG. 1 is a schematic view of an antenna and balun according to an embodiment of the subject invention.

FIG. 1 is a schematic view of an antenna and balun according to an embodiment of the subject invention. Referring to FIG. 1, the antenna platform can be a high isolation design. The vertically polarized Tx can be, for example, a flared monopole. The Rx antenna can be, for example, a horizontally polarized ring antenna, which is analogous to two dipoles with their arms wrapped in a circle. FIG. 1 lists dimensions for certain elements of the device, but these are included for exemplary purposes only and should not be construed as limiting. In a particular embodiment, a 1.7 $\lambda_{HIGH}$ (high wavelength) diameter ground plane can back both antennas at a height of 39 mm or approximately $\lambda_{HIGH}/4$. The balun for the ring antenna can be an exponential tapered microstrip balun (e.g., a balun that is 45 mm long, though embodiments are not limited thereto).

Figure 2:
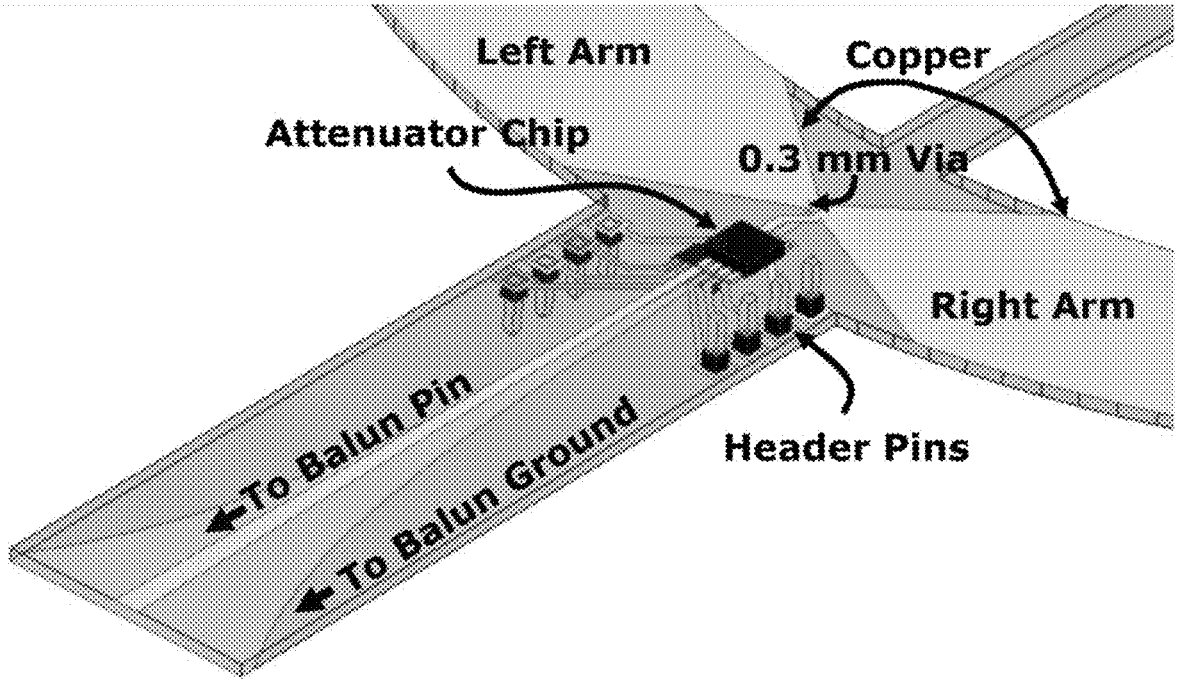
FIG. 2 is an enlarged view of the balun section of the device of FIG. 1, showing a balun with an attenuator chip, according to an embodiment of the subject invention.
Figure 3:
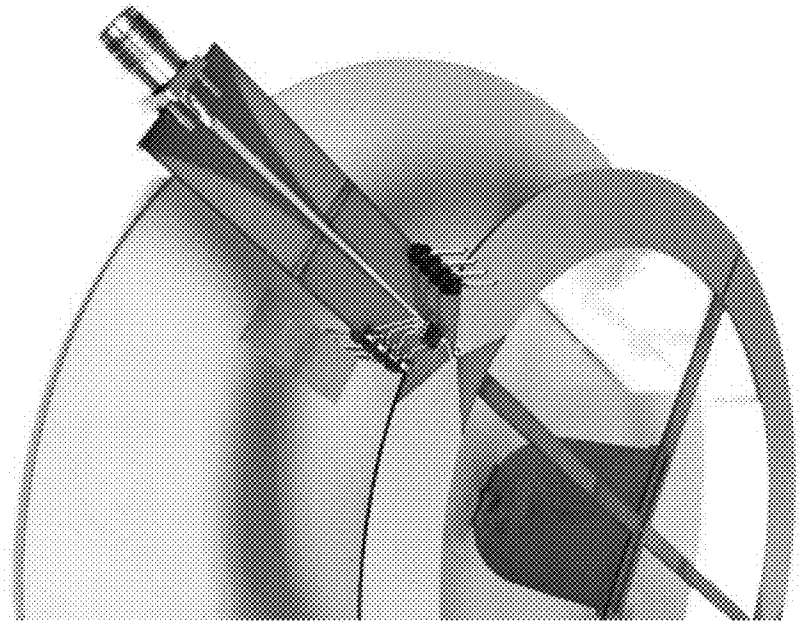
FIG. 3 is an image of a portion of an antenna and a balun according to an embodiment of the subject invention.

To determine the approximate amplitude imbalance of a balun, two back-to-back baluns can be considered. One balun can have inverted polarities connected (i.e., signal-ground on one balun connected to ground-signal of the other, respectively). The difference in $S_{21}$ for two such baluns can be used to estimate the amplitude imbalance of a single balun (e.g., <0.4 dB or <about 0.4 dB). To compensate for the imbalance, an attenuator chip can be placed on each arm of the balun. FIGS. 2 and 3 show a close-up of the balun with the attenuator chip thereon; though FIG. 2 lists dimensions for certain elements of the device, these are included for exemplary purposes only and should not be construed as limiting. The attenuation can be controlled by, for example, a direct current (DC) voltage. The voltage source can be a DC power supply, though embodiments are not limited thereto. To correct the amplitude error, fine control over the balun's excitation amplitude can be exercised.

Figure 4:
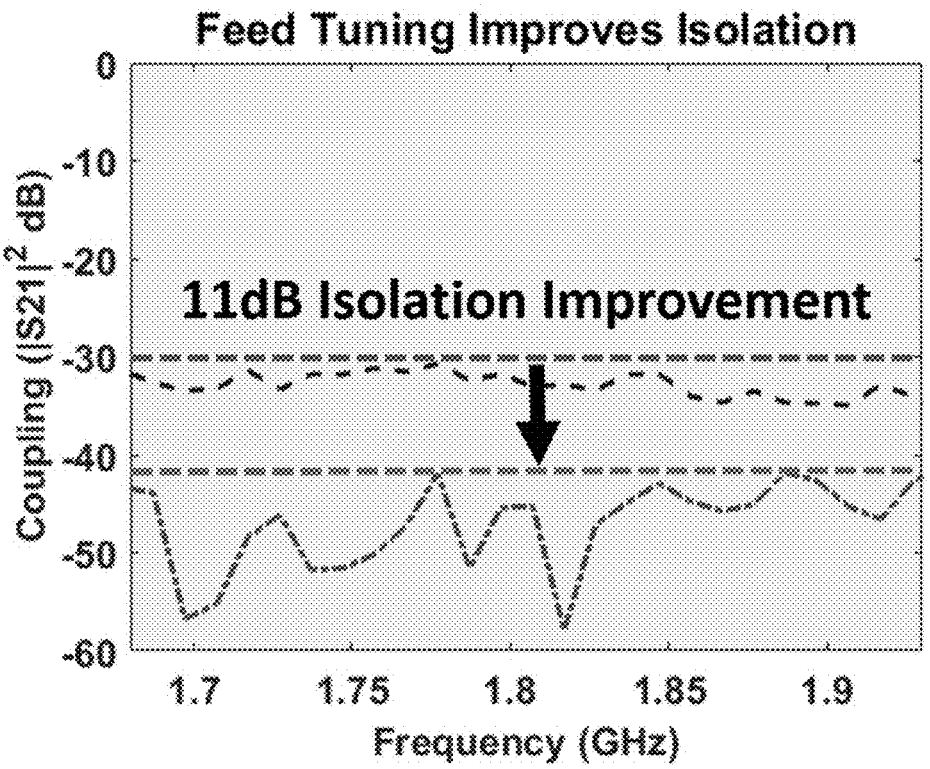
FIG. 4 is a plot showing $|S_{21}|^2$ (in decibels (dB)) versus frequency (in gigahertz (GHz)) showing increased isolation for a tuned balun compared to an untuned balun.

Measurements on actual fabricated back-to-back baluns as discussed herein indicated the attenuation can be reliably controlled by steps of <0.1 dB. FIG. 4 is a plot showing $|S_{21}|^2$ (in dB) versus frequency (in GHz) showing increased isolation for the tuned balun compared to the untuned balun. Referring to FIG. 4, the isolation was improved by >11 dB by tuning the attenuator chip(s) on the balun(s). This resulted in achievable antenna isolation of >42 dB across a bandwidth of >250 megahertz (MHz). One major advantage of using the attenuator chip is its capability of selective tuning across a selected range of frequencies.

Figure 28:
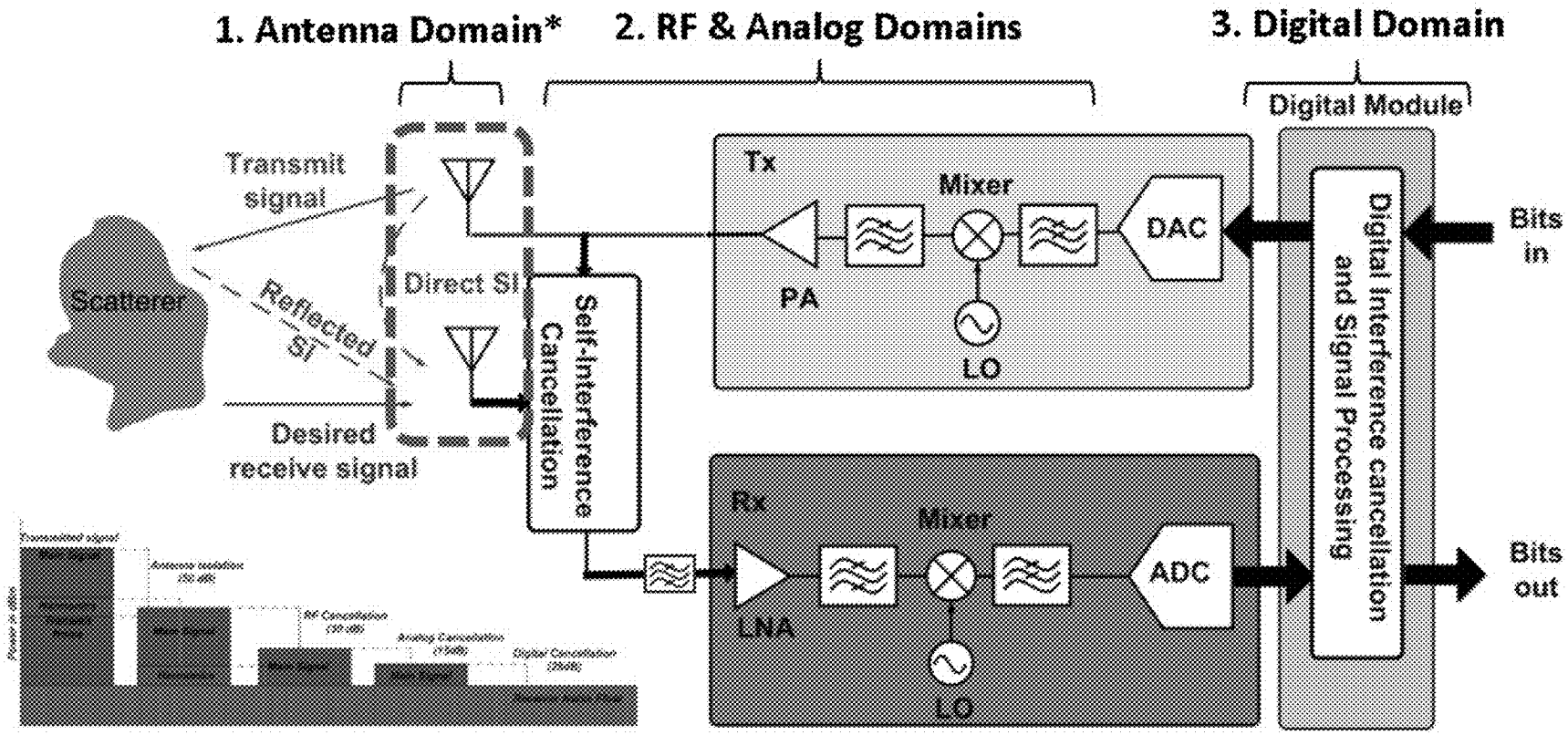
FIG. 28 is a diagram showing three cancellation stages in a simultaneous transmit and receive (STAR) antenna.
Figure 29:
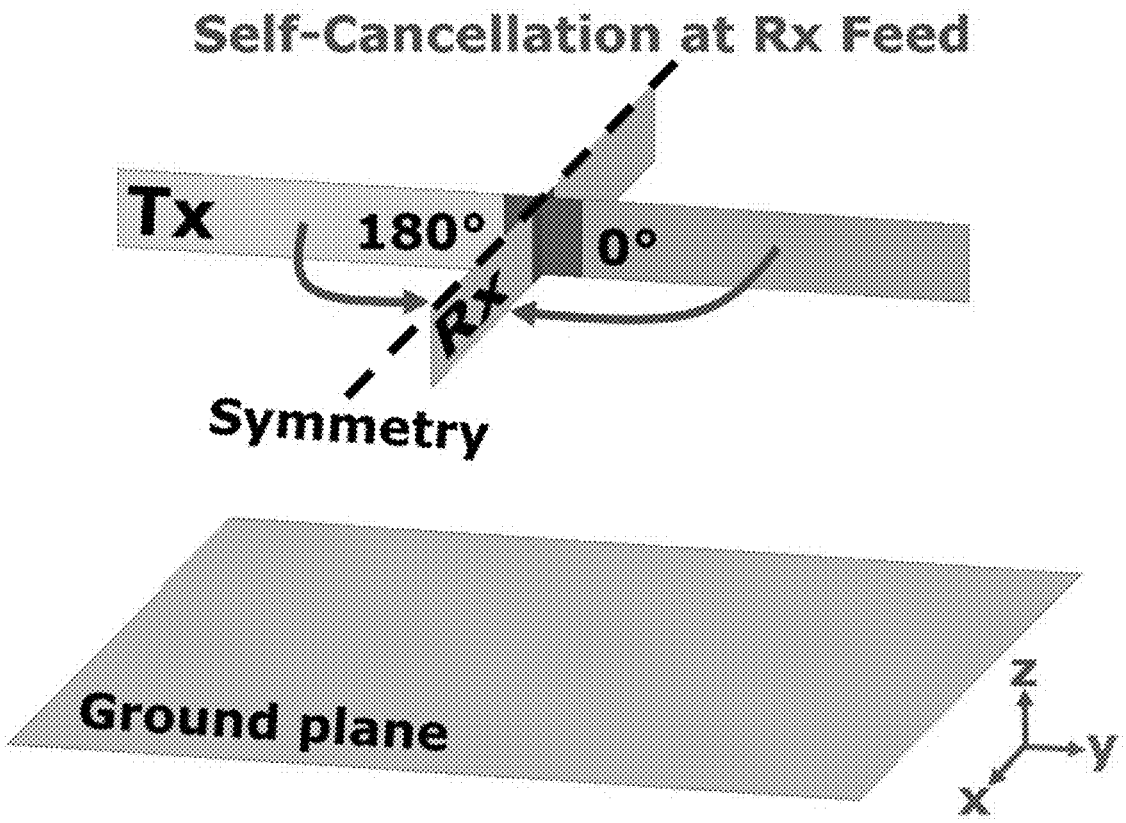
FIG. 29 is a schematic view of an antenna that can be used with a balun, according to an embodiment of the subject invention.
Figure 30:
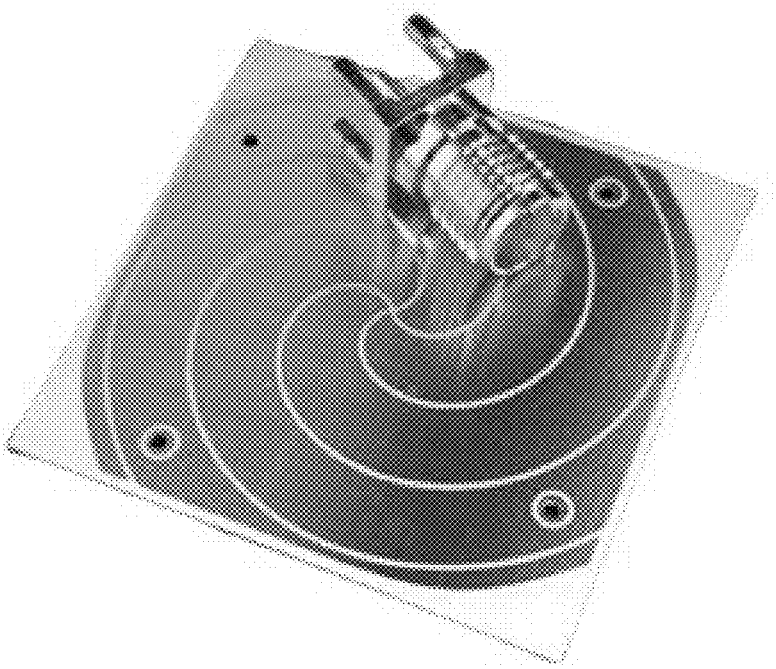
FIG. 30 is an image of an antenna that can be used with a balun, according to an embodiment of the subject invention.
Figure 31:
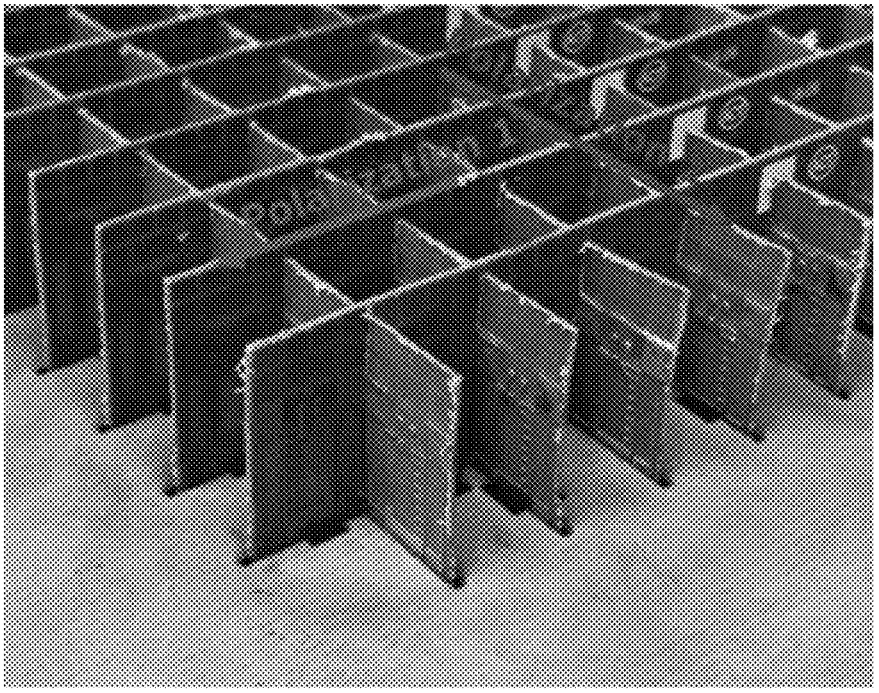
FIG. 31 is an image of an antenna that can be used with a balun, according to an embodiment of the subject invention.

FIG. 28 is a diagram showing three cancellation stages in a STAR antenna. STAR achieves twice the capacity compared to time/frequency division duplexing (TDD/FDD) with self-interference cancellation (SIC). FIGS. 29, 30, and 31 show examples of STAR antennas, each of which could be used with a balun in embodiments of the subject invention. FIG. 29 shows an antenna with self-cancellation at the Rx feed; FIG. 30 shows a four-arm spiral; and FIG. 31 shows a tightly-coupled dipole array.

Figure 5:
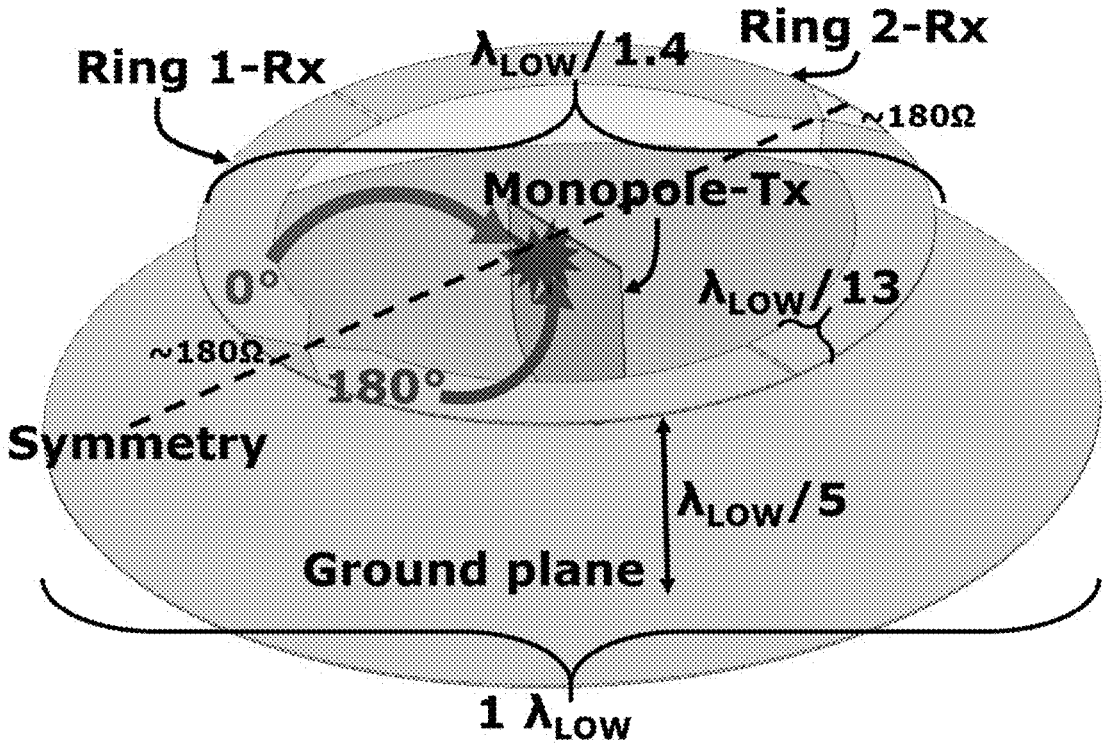
FIG. 5 is a schematic view showing an antenna that can be used with a balun, according to an embodiment of the subject invention.
Figure 6:
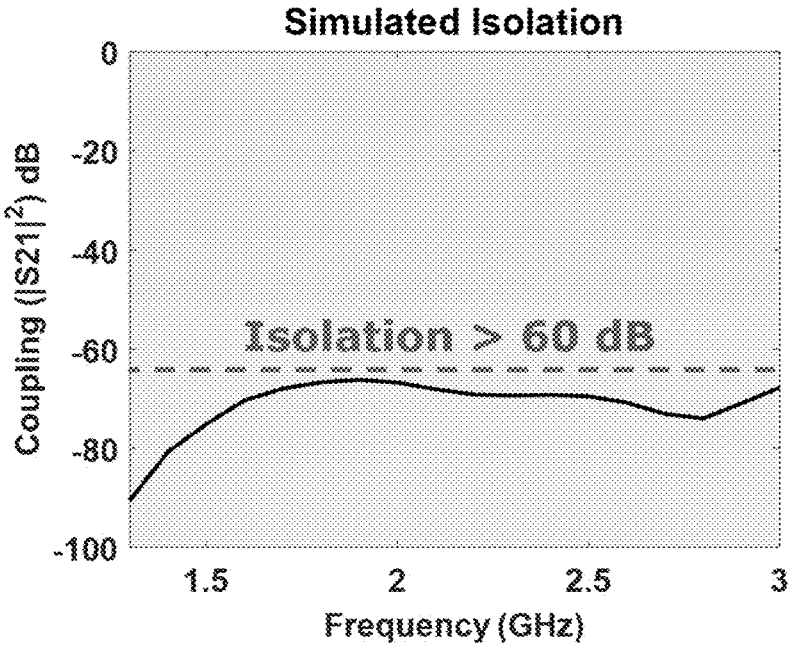
FIG. 6 is a plot of $|S_{21}|^2$ (in dB) versus frequency (in GHz) showing simulated isolation for the antenna of FIG. 5.
Figure 7:
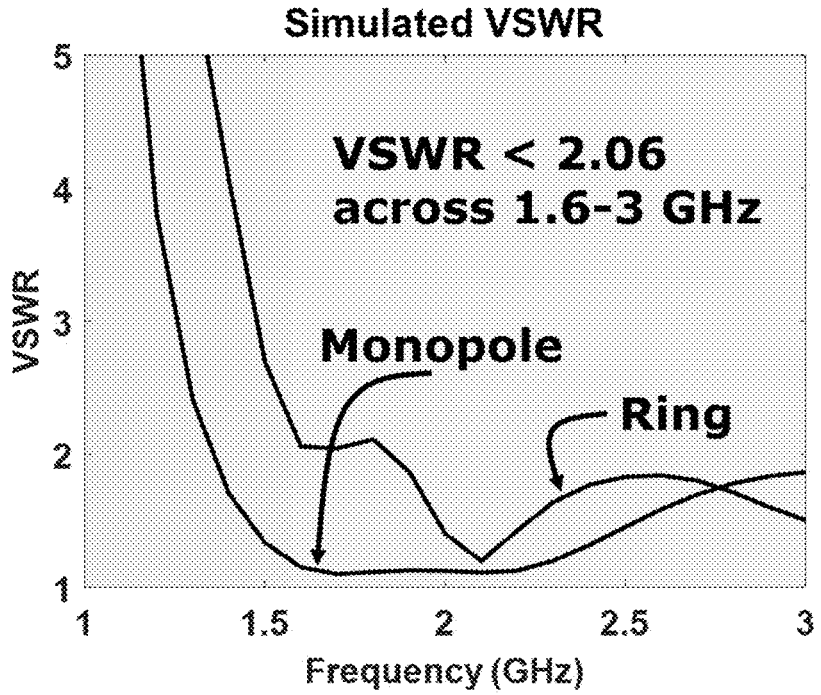
FIG. 7 is a plot of simulated voltage standing wave ratio (VSWR) versus frequency (in GHz) for the antenna of FIG. 5.
Figure 8:
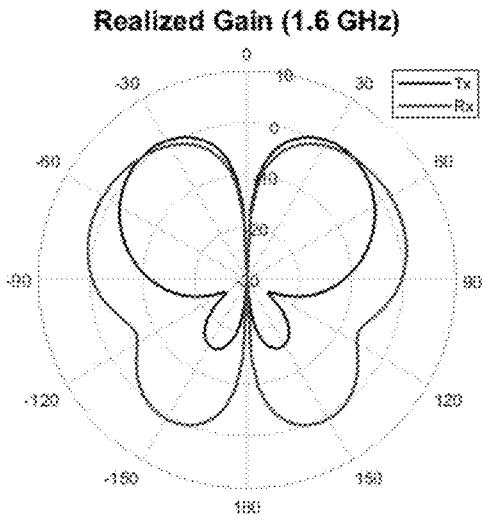
FIG. 8 is a view of realized gain (at 1.6 GHz) for the antenna of FIG. 5; the outermost (blue) line is for the receiver (Rx), and the innermost (black) line is for the transmitter (Tx).

FIG. 5 is a schematic view showing an antenna that can be used with a balun, according to an embodiment of the subject invention. This style antenna uses a monopole Tx and a ring Rx (two antennas) (see also Yetisir et al., "Wideband dual-polarized omnidirectional antenna with very high isolation across 1.65-2.7 GHz," 2014 IEEE APSURSI, 2014, pp. 1123-1124; which is hereby incorporated herein by reference in its entirety). FIG. 6 is a plot of $|S_{21}|^2$ (in dB) versus frequency (in GHz) showing simulated isolation for the antenna of FIG. 5; FIG. 7 is a plot of simulated voltage standing wave ratio (VSWR) versus frequency (in GHz) for the antenna of FIG. 5; and FIG. 8 is a view of realized gain (at 1.6 GHz) for the antenna of FIG. 5; the outermost (blue) line is for the Rx, and the innermost (black) line is for the Tx.

Figure 9:
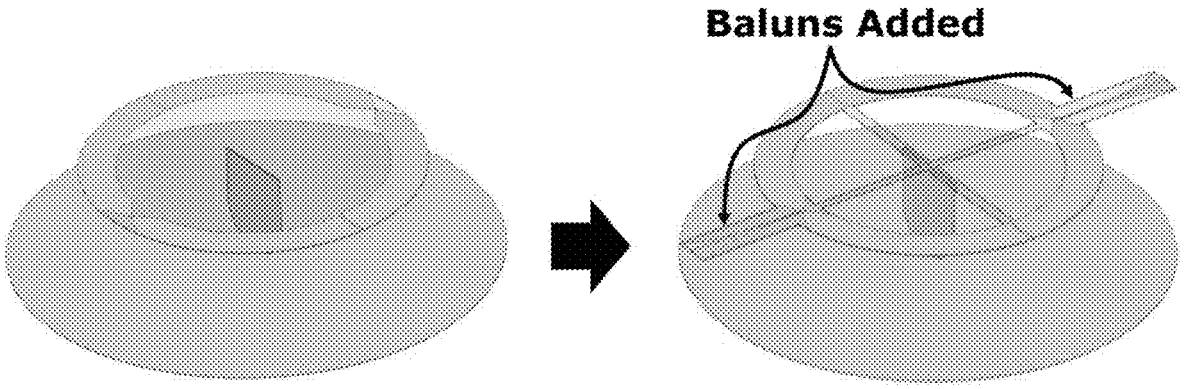
FIG. 9 is a schematic view showing at least one balun added to an antenna similar to the one in FIG. 5, according to an embodiment of the subject invention.
Figure 10:
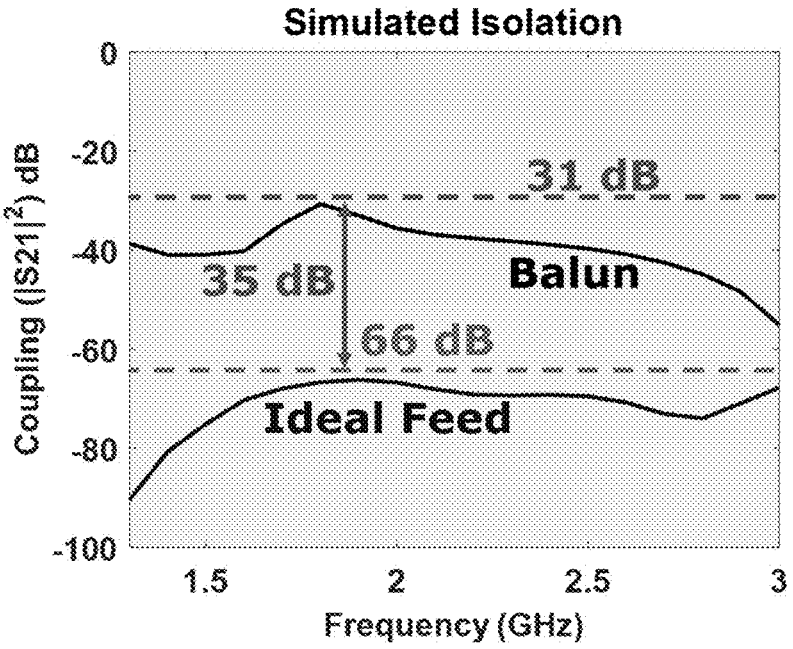
FIG. 10 is a plot of $|S_{21}|^2$ (in dB) versus frequency (in GHz) showing simulated isolation for the antenna of FIG. 9 including the balun.
Figure 11:
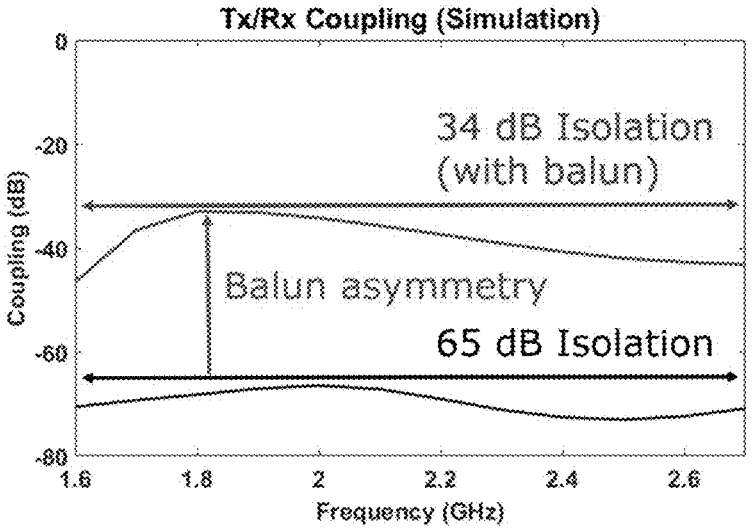
FIG. 11 is a plot of coupling (in dB) versus frequency (in GHz) showing simulated Tx/Rx coupling for the antenna of FIG. 9 including the balun.
Figure 12A:
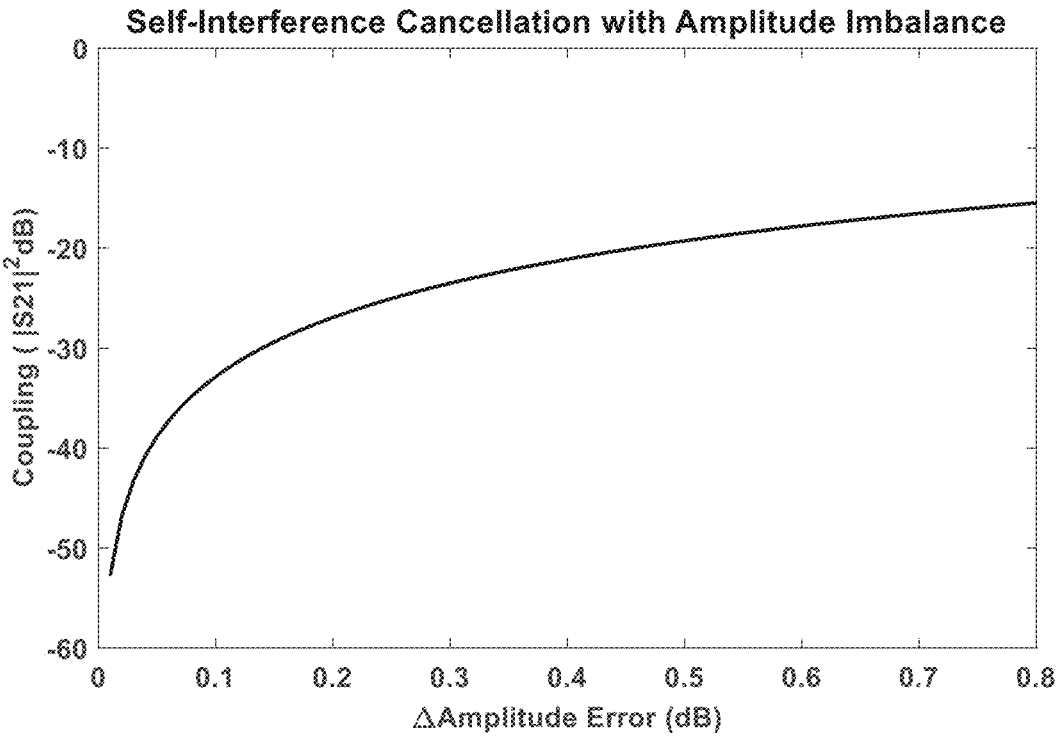
FIG. 12A is a plot of coupling ($|S_{21}|^2$, in dB) versus ΔAmplitude error (in dB)
Figure 12B:
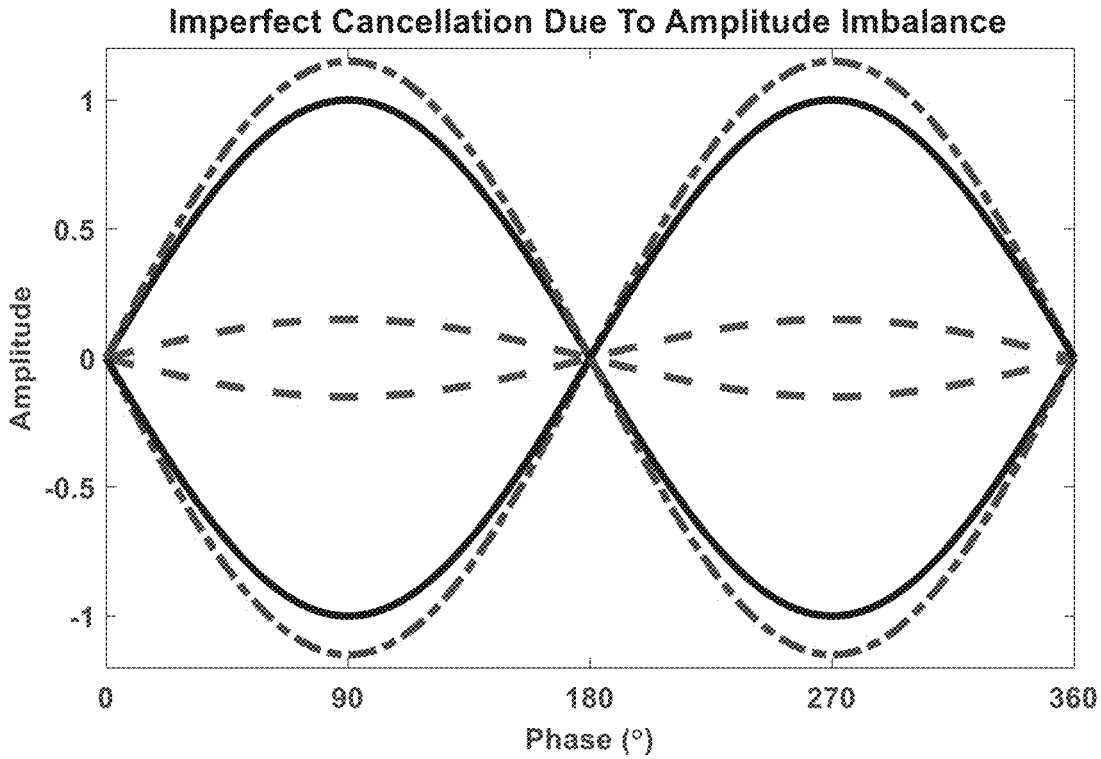
FIG. 12B is a plot of amplitude versus phase (in degrees) showing imperfect cancellation due to misaligned coupling signals, for the antenna of FIG. 9.
Figure 13:
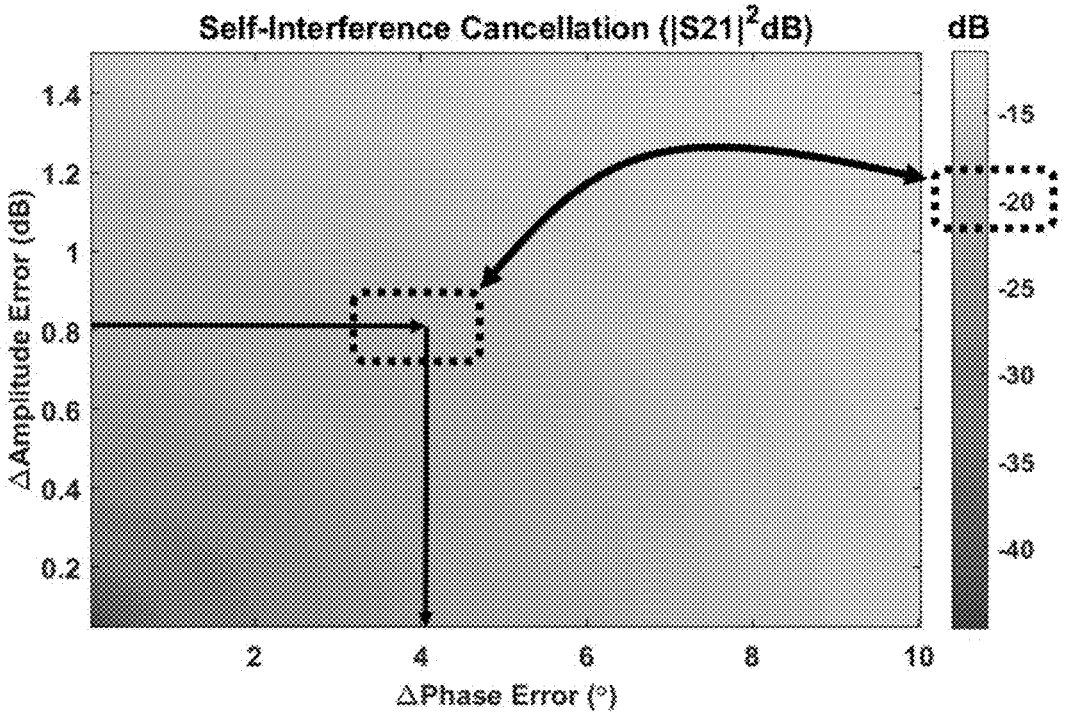
FIG. 13 is a plot of Δ amplitude error (in dB) versus Δ phase error (in degrees) self-interference cancellation for the antenna of FIG. 9.

FIG. 9 is a schematic view showing at least one balun added to an antenna similar to the one in FIG. 5, according to an embodiment of the subject invention. FIG. 10 is a plot of $|S_{21}|^2$ (in dB) versus frequency (in GHz) showing simulated isolation for the antenna of FIG. 9 including the balun, and FIG. 11 is a plot of coupling (in dB) versus frequency (in GHz) showing simulated Tx/Rx coupling for the antenna of FIG. 9 including the balun. FIG. 12A is a plot of coupling versus ΔAmplitude showing self-interference cancellation with amplitude imbalance, and FIG. 12B is a plot of amplitude versus phase (in degrees) showing imperfect cancellation due to amplitude imbalance, for the antenna of FIG. 9. FIG. 13 is a plot of A amplitude error (in dB) versus Δ phase error (in degrees) self-interference cancellation for the antenna of FIG. 9.

Figure 14:
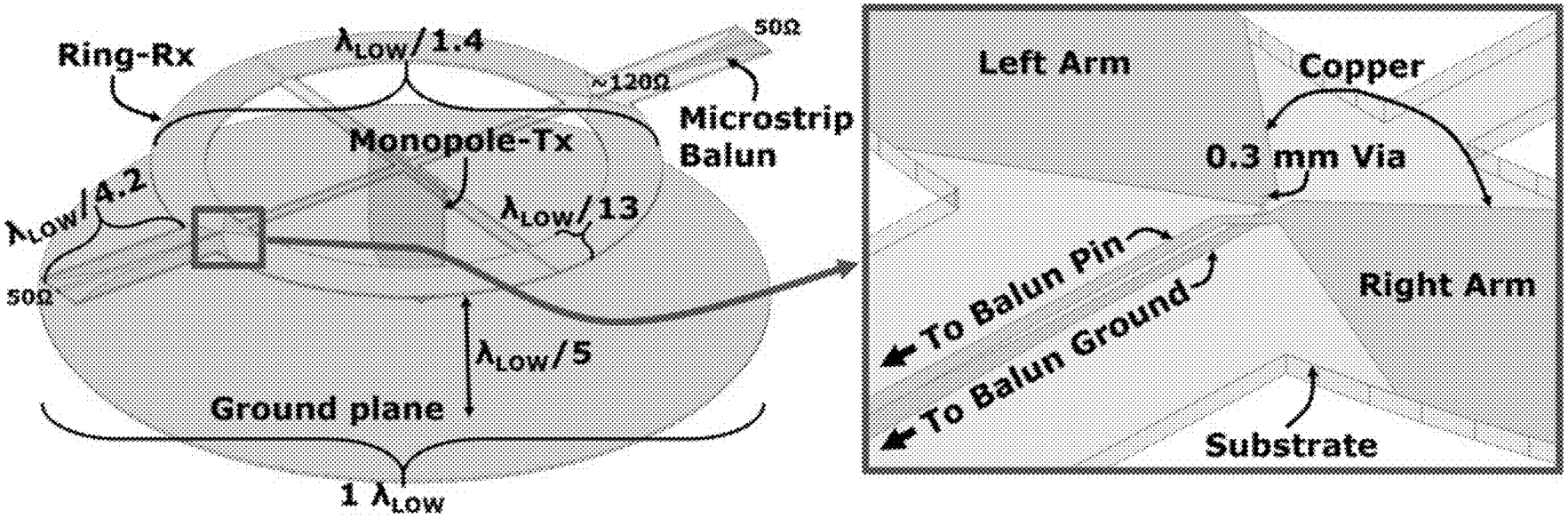
FIG. 14 is a schematic view of an antenna and balun according to an embodiment of the subject invention. The enlarged portion shows traces to the balun pin and balun ground from two sides, respectively, of the Rx antenna.
Figure 15:
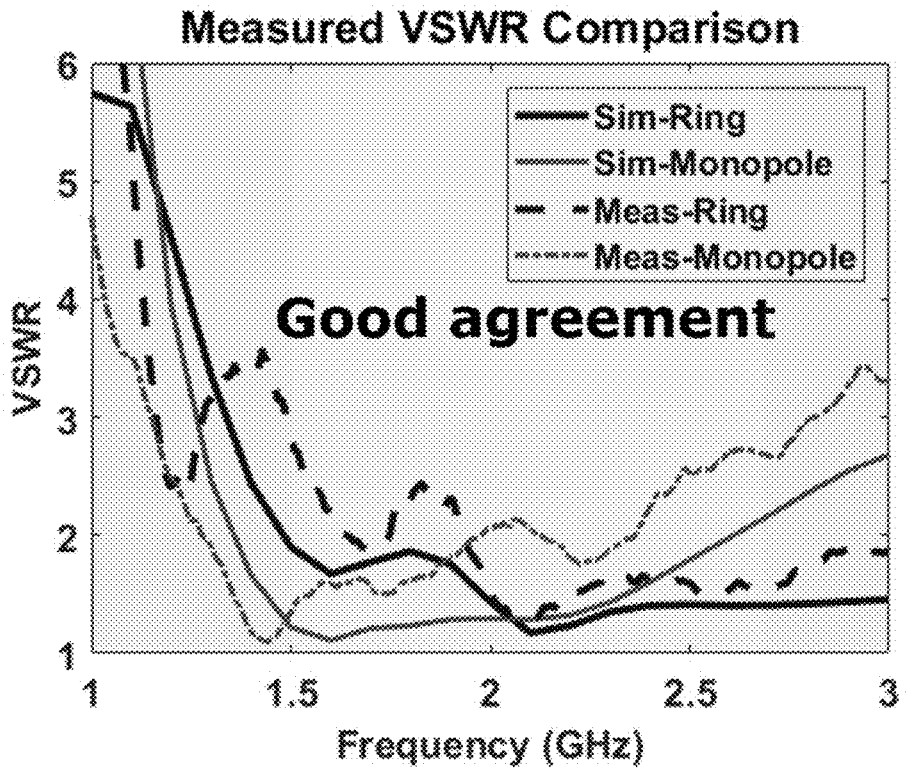
FIG. 15 is a plot of measured VSWR and simulated VSWR versus frequency (in GHz) for the antenna of FIG. 14.
Figure 16:
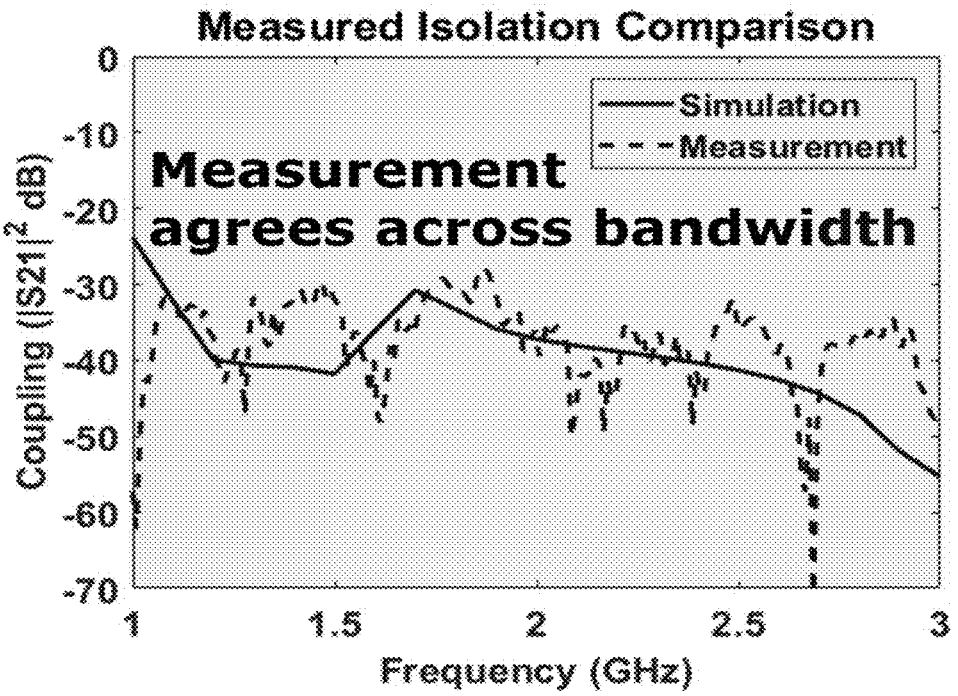
FIG. 16 is a plot of measured and simulated coupling ($|S_{21}|^2$, in dB) versus frequency (in GHz) for the antenna of FIG. 14.

FIG. 14 is a schematic view of an antenna and balun according to an embodiment of the subject invention. The enlarged portion shows traces to the balun pin and balun ground from two sides, respectively, of the Rx antenna. FIG. 15 is a plot of measured VSWR and simulated VSWR versus frequency (in GHz) for the antenna of FIG. 14, and FIG. 16 is a plot of measured and simulated coupling ($|S_{21}|^2$, in dB) versus frequency (in GHz) for the antenna of FIG. 14.

Figure 17:
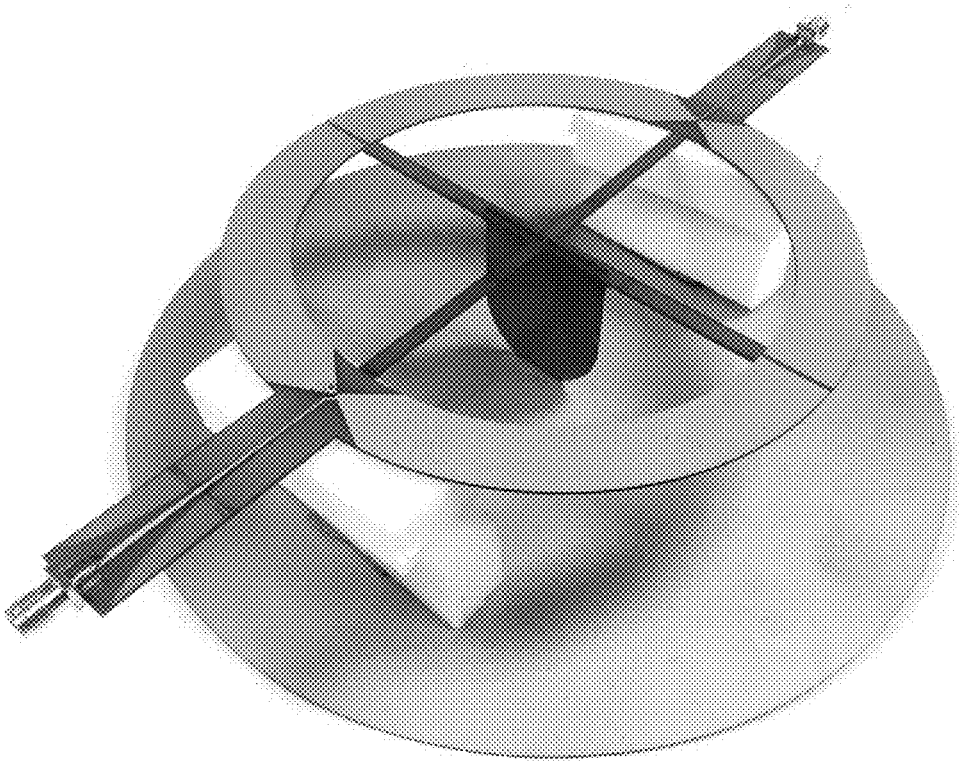
FIG. 17 is an image showing an antenna with a balun, according to an embodiment of the subject invention.
Figure 18:
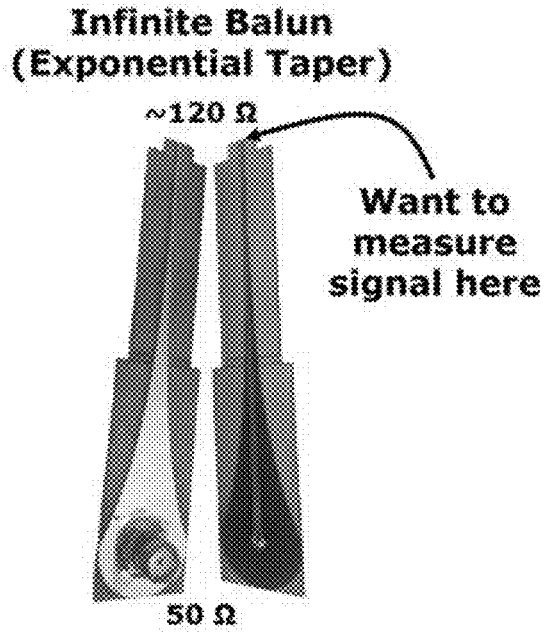
FIG. 18 shows an image of two baluns that can be used in embodiments of the subject invention.
Figure 19:
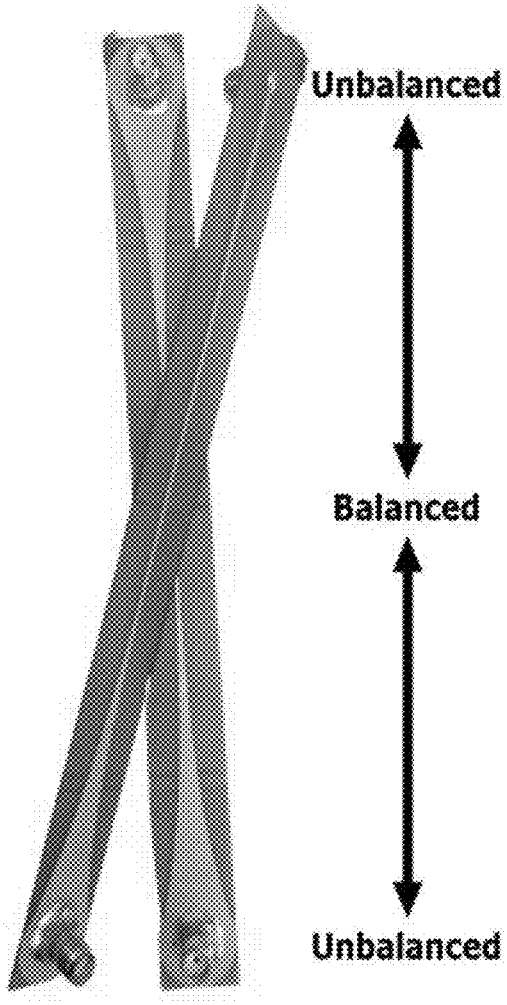
FIG. 19 shows an image of two baluns that can be used in embodiments of the subject invention.
Figure 20:
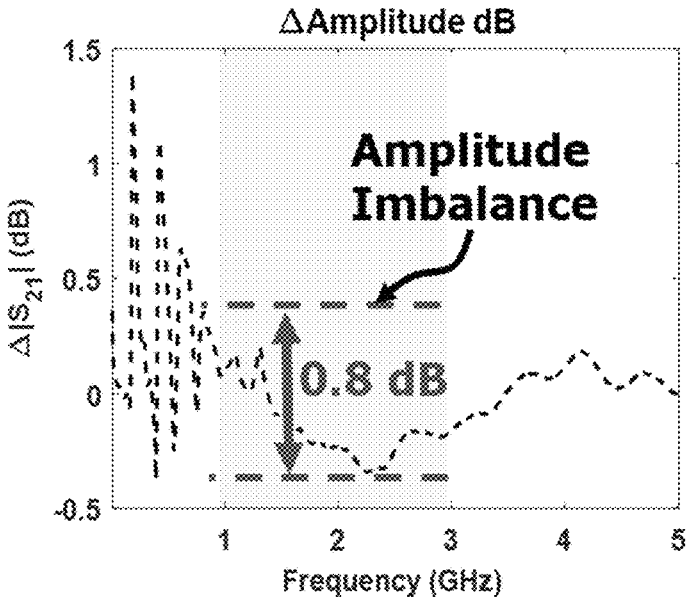
FIG. 20 is a plot of $\Delta|S_{21}|^2$ (in dB) versus frequency (in GHz) showing amplitude imbalance.

FIG. 17 is an image showing an antenna with a balun, according to an embodiment of the subject invention, while FIGS. 18 and 19 each show an image of two baluns that can be used in embodiments of the subject invention. FIG. 20 is a plot of $\Delta|S_{21}|^2$ (in dB) versus frequency (in GHz) showing amplitude imbalance. A tunable balun can be used to correct the amplitude imbalance.

Figure 21:
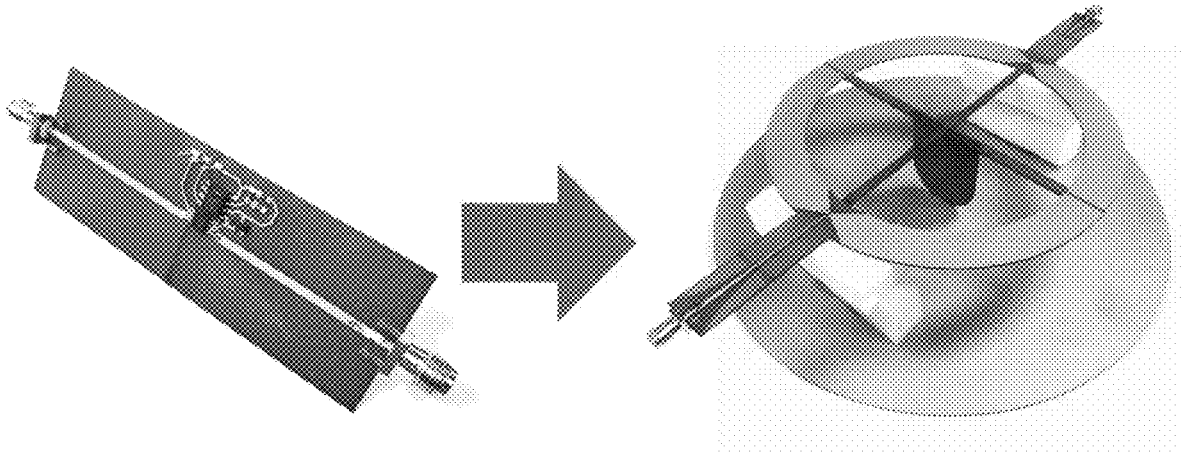
FIG. 21 is an image of a balun with an attenuator chip thereon that can be used with an antenna (seen on the right hand portion of the figure), according to an embodiment of the subject invention.
Figure 22:
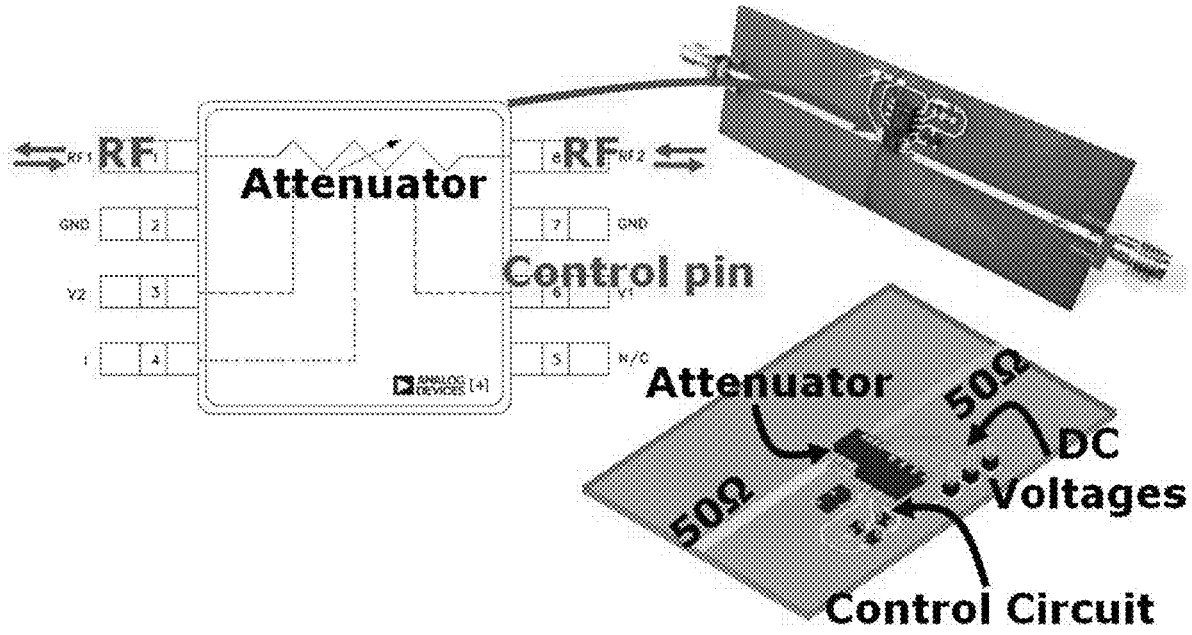
FIG. 22 is a diagram of an attenuator that can be used with a balun, according to an embodiment of the subject invention.

FIG. 21 is an image of a balun with an attenuator chip thereon that can be used with an antenna (seen on the right hand portion of the figure), according to an embodiment of the subject invention. FIG. 22 is a diagram of an attenuator that can be used with a balun. The attenuator chip can include a control circuit and/or a control pin. Although FIG. 22 shows certain values (e.g., 50Ω), these are for exemplary purposes only and should not be construed as limiting.

Embodiments of the subject invention provide high antenna cancellation approaches that can be employed with any radio. Tunable baluns (with attenuator chips thereon) integrated onto antennas can be used in a multi-antenna radio to provide an average isolation of >42 dB across a bandwidth of ≥250 MHz. The small volume and passive circuitry of the tunable balun make its implementation suitable for many applications, including but not limited to future 5G communication, radars, and remote sensing applications.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

Figure 23:
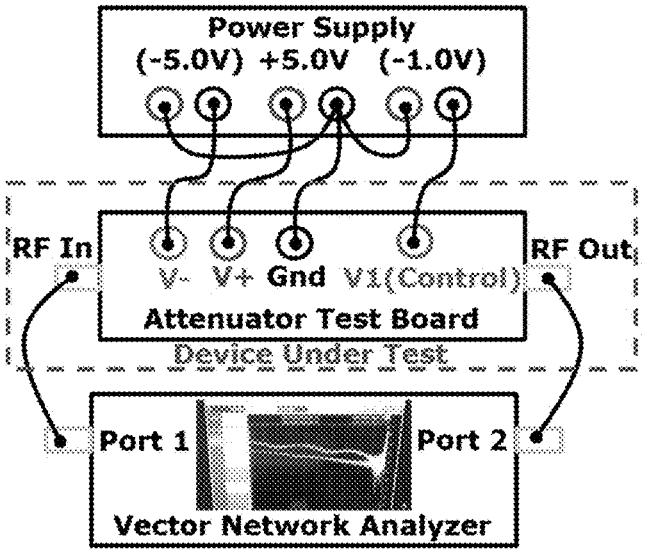
FIG. 23 is a schematic representation of an experimental setup used to test antennas and baluns.

FIG. 23 is a schematic representation of an experimental setup used to test antennas and baluns of embodiments of the subject invention. This experimental setup was used to test the antenna shown in FIGS. 1-3 and that shown in FIG. 21 (with and without the attenuator chip).

Figure 24:
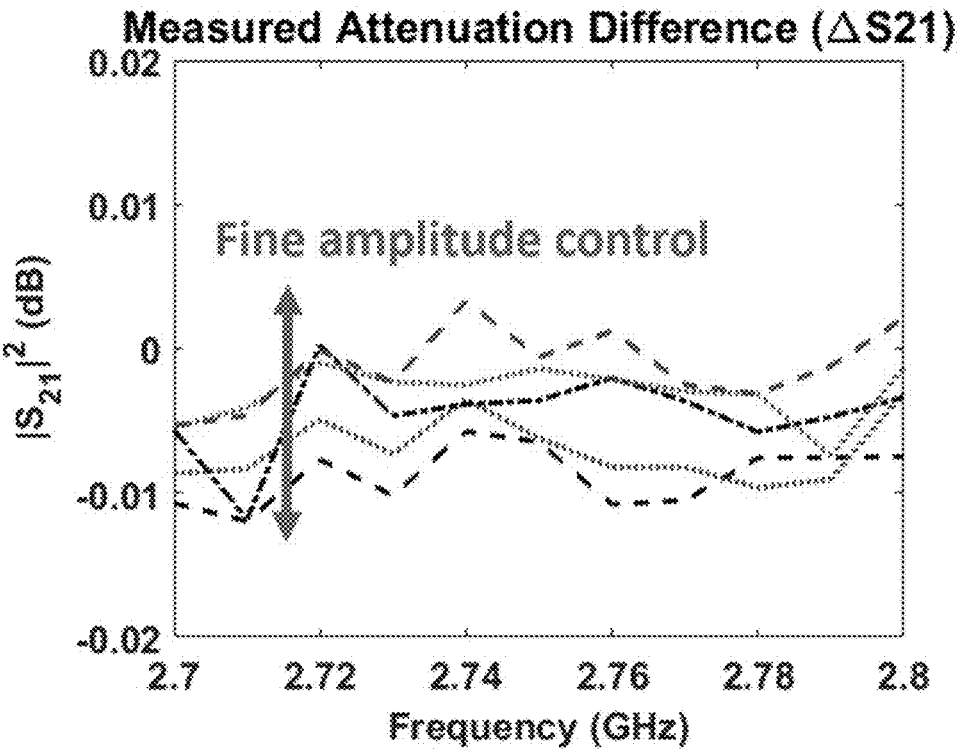
FIG. 24 is a plot of $|S_{21}|^2$ (in dB) versus frequency (in GHz) showing measured attenuation difference and fine amplitude control for the antenna of FIG. 21 including the balun and attenuator chip.
Figure 25:
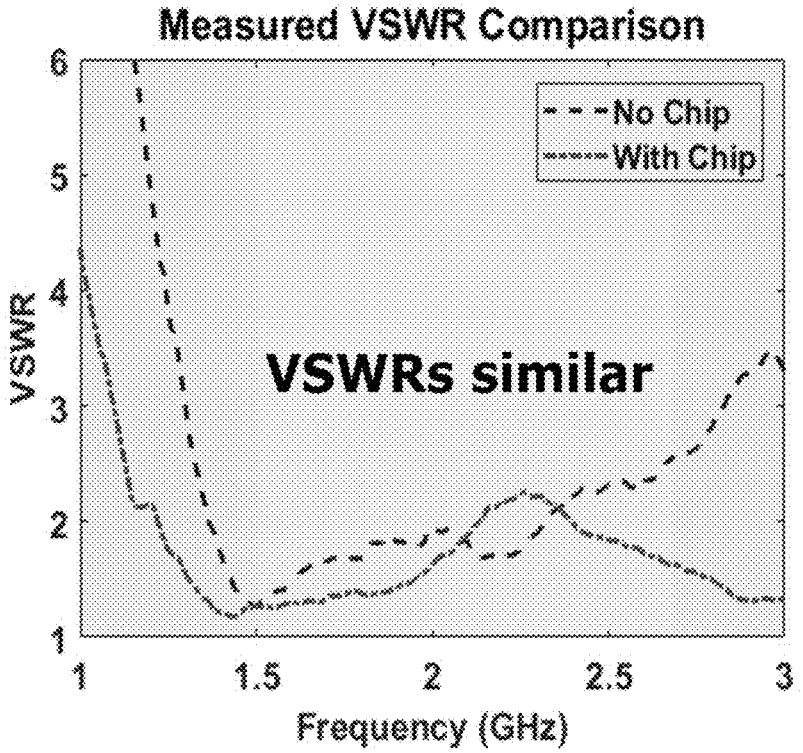
FIG. 25 is a plot of measured VSWR versus frequency (in GHz) for the antenna of FIG. 21 with and without the attenuator chip on the balun.
Figure 26:
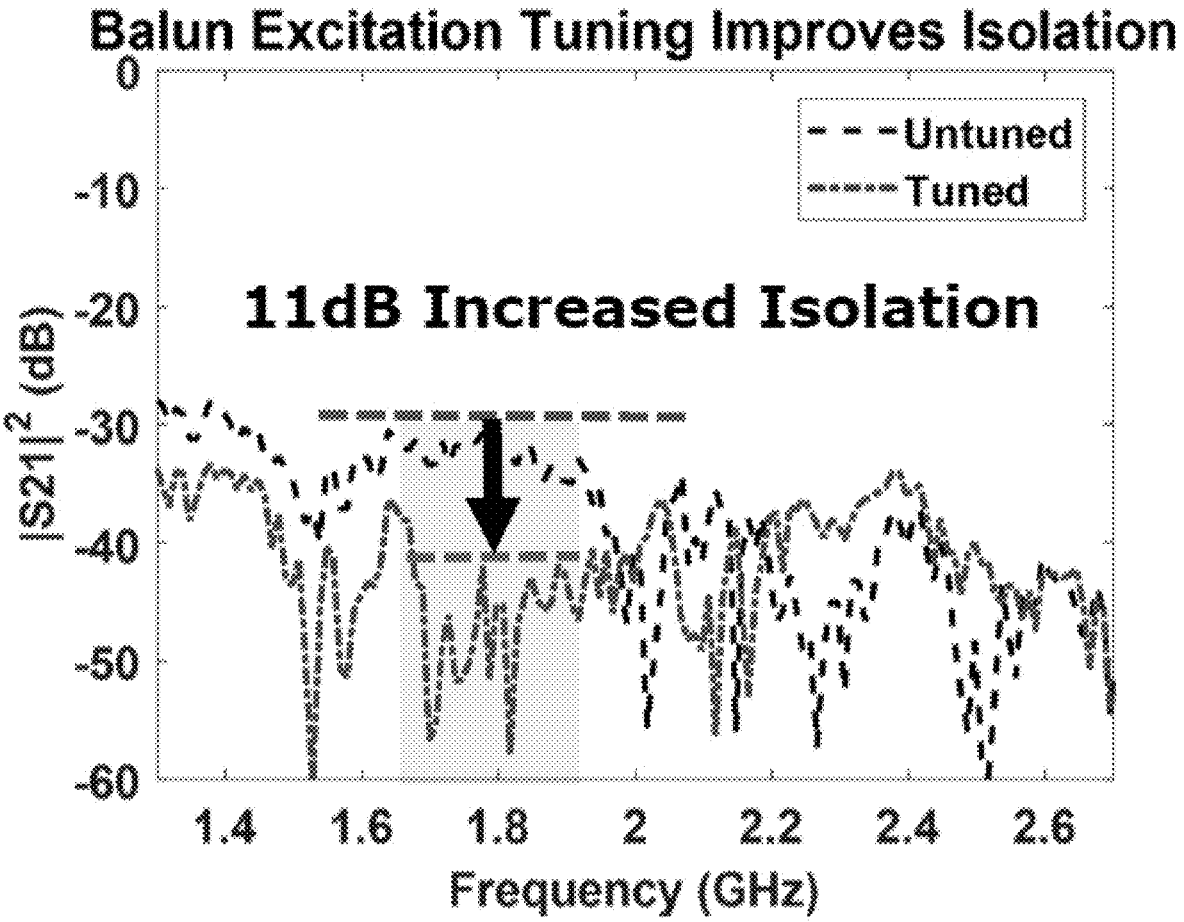
FIG. 26 is a plot of $|S_{21}|^2$ (in dB) versus frequency (in GHz) for the antenna of FIG. 21 including the balun and attenuator chip.
Figure 27:
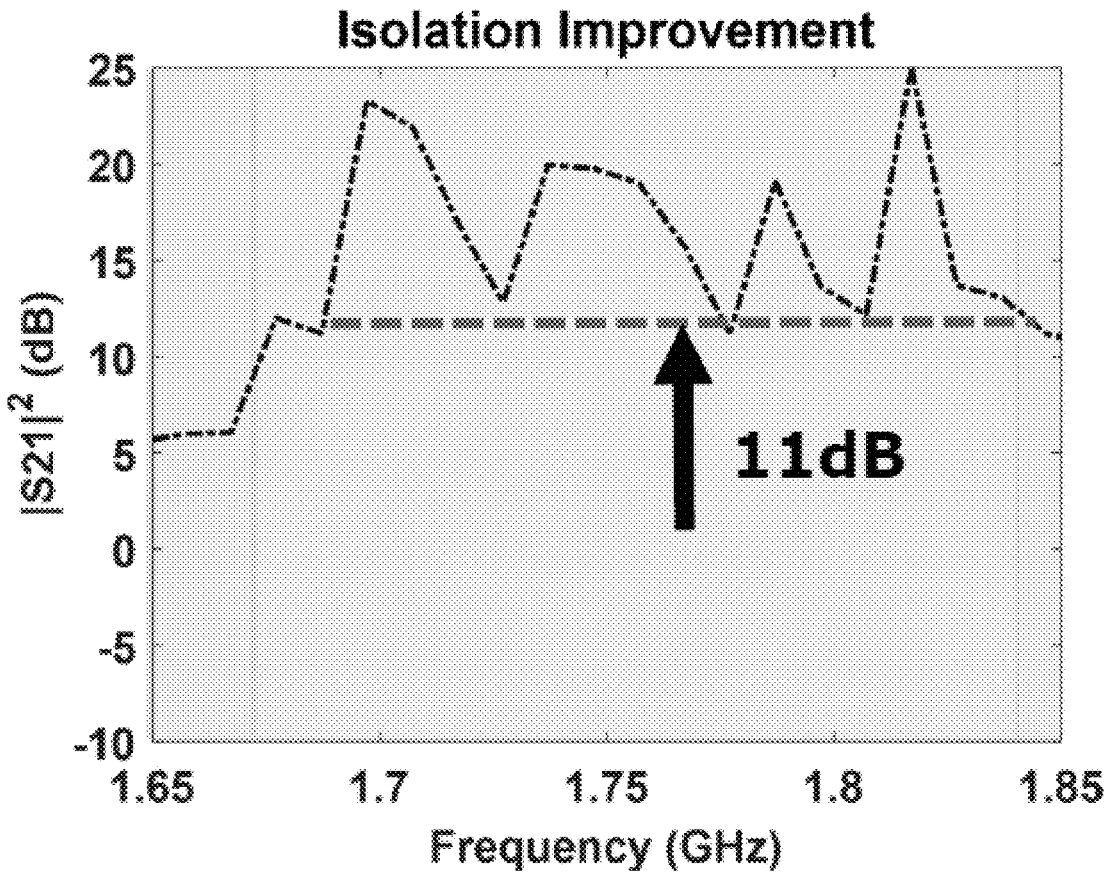
FIG. 27 is a plot of $|S_{21}|^2$ (in dB) versus frequency (in GHz) for the antenna of FIG. 21 including the balun and attenuator chip, showing isolation improvement.

FIG. 24 is a plot of $|S_{21}|^2$ (in dB) versus frequency (in GHz) showing measured attenuation difference and fine amplitude control for the antenna of FIG. 21 including the balun and attenuator chip. FIG. 25 is a plot of measured VSWR versus frequency (in GHz) for the antenna of FIG. 21 with and without the attenuator chip on the balun. FIG. 26 is a plot of $|S_{21}|^2$ (in dB) versus frequency (in GHz) for the antenna of FIG. 21 including the balun and attenuator chip. FIG. 26 shows results for the balun being tuned or untuned, with an increased isolation of about 11 dB when the balun is tuned. FIG. 27 is a plot of $|S_{21}|^2$ (in dB) versus frequency (in GHz) for the antenna of FIG. 21 including the balun and attenuator chip, showing isolation improvement.

Referring to FIGS. 24-27, it can be seen that the tunable balun provides fine amplitude control with similar VSWR as the balun without the attenuator chip. Also, isolation improvement of at least 11 dB is achieved with the tunable balun.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. An antenna device, comprising:

a transmitter antenna portion (Tx);

a receiver antenna portion (Rx) comprising a substrate and a first dipole and a second dipole disposed on the substrate; and a balun disposed on the substrate of the Rx, the balun having an attenuator chip thereon and being a tunable balun, and the balun being disposed entirely in a same plane as the first dipole and the second dipole of the Rx, the balun comprising a balun pin and a balun ground at a distal end thereof, the balun being connected to the first dipole and the second dipole of the Rx at a proximal end thereof opposite from the distal end, and the attenuator chip being disposed on the balun closer to the proximal end than it is to the distal end.

2. The antenna device according to claim 1, the balun being integrated with the first dipole and the second dipole of the Rx.

3. The antenna device according to claim 1, further comprising a ground plane disposed under the Rx and the Tx.

4. The antenna device according to claim 1, the Tx being a monopole antenna and the Rx being a ring antenna.

5. The antenna device according to claim 1, the Rx being a horizontally polarized ring antenna comprising the first dipole and the second dipole wrapped in a ring shape.

6. The antenna device according to claim 1, the balun being an exponential tapered balun.

7. The antenna device according to claim 1, the balun being an exponential tapered microstrip balun.

8. The antenna device according to claim 1, the antenna device being configured such that the attenuator chip is controlled by a direct current (DC) voltage.

9. The antenna device according to claim 1, the antenna device being configured such that an isolation between the Rx and Tx of greater than 42 decibels (dB) is achieved.

10. The antenna device according to claim 1, the Rx being a horizontally polarized ring antenna comprising a first dipole and a second dipole wrapped in a ring shape, the balun ground being electrically connected to the first dipole of the Rx, and the balun pin being electrically connected to the second dipole of the Rx.

11. The antenna device according to claim 1, the attenuator chip comprising an attenuator comprising eight pins, the eight pins comprising two radio frequency (RF) pins, two ground pins, and two voltage pins.

12. The antenna device according to claim 1, the attenuator chip comprising an attenuator and a control circuit connected to the attenuator.

13. An antenna device, comprising:

a transmitter antenna portion (Tx);

a receiver antenna portion (Rx) comprising a substrate and a first dipole and a second dipole disposed on the substrate;

a ground plane disposed under the Rx and the Tx; and a balun disposed on the substrate of the Rx and integrated with the first dipole and the second dipole of the Rx, the balun having an attenuator chip thereon and being a tunable balun, the balun being disposed entirely in a same plane as the first dipole and the second dipole of the Rx the Tx being a monopole antenna and the Rx being a horizontally polarized ring antenna comprising the first dipole and the second dipole wrapped in a ring shape, the balun being an exponential tapered microstrip balun, the antenna device being configured such that the attenuator chip is controlled by a direct current (DC) voltage, the antenna device being configured such that an isolation between the Rx and Tx of greater than 42 decibels (dB) is achieved, the balun comprising a balun pin and a balun ground, the balun ground being electrically connected to the first dipole of the Rx, the balun pin being electrically connected to the second dipole of the Rx, the attenuator chip comprising an attenuator comprising two radio frequency (RF) pins, two ground pins, and two voltage pins, and the attenuator chip further comprising a control circuit connected to the attenuator.

* * * * *